US006386772B1

(12) United States Patent
Klinefelter et al.

(10) Patent No.: US 6,386,772 B1
(45) Date of Patent: May 14, 2002

(54) METHOD AND APPARATUS FOR COMMUNICATING BETWEEN PRINTER OR LAMINATOR AND SUPPLIES

(75) Inventors: Gary M. Klinefelter, Eden Prairie; Bradley A. Paulson, Northfield; Matthew K. Dunham, Eagan; Kevin R. Campion, Minnetonka; Jeffrey D. Upin, Edina; Gary A. Lenz; Aurelian Dumitru, both of Eden Prairie, all of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/489,591

(22) Filed: Jan. 21, 2000

Related U.S. Application Data

(60) Provisional application No. 60/117,123, filed on Jan. 25, 1999.

(51) Int. Cl.[7] ..... B41J 25/38

(52) U.S. Cl. ..... 400/208; 400/692; 346/825.31; 346/825.54; 347/177; 235/380

(58) Field of Search ..... 400/207, 208, 400/208.1, 692; 340/825.31, 825.54; 235/380; 347/177

(56) References Cited

U.S. PATENT DOCUMENTS

| | | | | | |
|---|---|---|---|---|---|
| 4,031,518 | A | * | 6/1977 | Holloran et al. | 340/172.5 |
| 4,797,018 | A | * | 1/1989 | Hofmann et al. | 400/208 |
| 4,845,490 | A | * | 7/1989 | Ward et al. | 340/825.31 |
| 5,138,344 | A | * | 8/1992 | Ujita | 400/175 |
| 5,149,211 | A | * | 9/1992 | Pettigrew et al. | 400/88 |
| 5,266,968 | A | * | 11/1993 | Stephenson | 400/208 |
| 5,267,800 | A | * | 12/1993 | Petteruti et al. | 400/88 |
| 5,318,370 | A | * | 6/1994 | Nehowig | 400/207 |
| 5,455,617 | A | * | 10/1995 | Stephenson et al. | 400/207 |
| 5,703,347 | A | | 12/1997 | Reddersen et al. | 235/472 |
| 5,707,162 | A | * | 1/1998 | Kasai et al. | 400/692 |
| 5,755,519 | A | | 5/1998 | Klinefelter | 400/249 |
| 6,011,741 | A | * | 1/2000 | Wallace et al. | 365/221 |
| 6,037,879 | A | * | 3/2000 | Tuttle | 340/825.54 |
| 6,039,430 | A | * | 3/2000 | Helterline et al. | 347/19 |
| 6,071,024 | A | * | 6/2000 | Chi-Ming et al. | 347/177 |
| 6,072,402 | A | * | 6/2000 | Kniffin et al. | 340/825.31 |
| 6,099,178 | A | * | 8/2000 | Spurr et al. | 400/207 |
| 6,213,392 | B1 | * | 4/2001 | Zuppicich | 235/380 |
| 6,252,791 | B1 | * | 6/2001 | Wallace et al. | 365/52 |

FOREIGN PATENT DOCUMENTS

| | | |
|---|---|---|
| EP | 0 562 979 A2 | 9/1993 |
| EP | 0 887 197 A2 | 12/1998 |
| EP | 0 979 736 A1 | 2/2000 |
| WO | WO 99/49379 | 9/1999 |

OTHER PUBLICATIONS

"Standard Read/Write Identification IC", by TEMIC Semiconductor GmbH, Heilbronn, Germany, (Apr. 1999).
"Introducing the New SmartGuard™ and SmartShield™ Advanced Security Options", pamphlet by Fargo Electronics, Inc., Eden Prairie, Minnesota (1998) .
"RFID Tagging IC is First to Accept Input from Sensors", by Microchip Technology Inc., (undated).

* cited by examiner

*Primary Examiner*—Eugene Eickholt
(74) *Attorney, Agent, or Firm*—Brian D. Kaul; Westman, Champlin & Kelly

(57) ABSTRACT

A printer for printing onto a substrate includes a substrate feed mechanism configured to secure the substrate during printing and a print mechanism configured to print on the substrate. A transceiver is configured to transfer power through a non-physical link to a radio frequency (RF) circuit carried on a printer supply to thereby power the RF circuit. The transceiver also responsively receives printer supply data through a non-physical link from the RF circuit.

36 Claims, 8 Drawing Sheets

RFID TAG MEMORY MAP

| BIT | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| BLOCK 0 | MODE DATA (NOT NORMALLY TRANSMITTED) | | | | | | | | | | | | | | | | | | | | | | | | | | | | | | | |
| BLOCK 1 | NUMBER OF IMAGES (UP TO 4,096) | | | | | | | | | | | | MATERIAL (16) | | | | | SUPPLIER (16) | | | | PANEL SIZE (16) | | | | THICKNESS (16) | | | | NOT USED | | |
| BLOCK 2 | LOT CODE (4096) | | | | | | | | | | | | MONTH EXP. DATE | | | | | YEAR EXP. DATE (2256) | | | | | | | | NOT USED | | | | | | |
| BLOCK 3 | ROLL ID (UP TO 655536) | | | | | | | | | | | | | | | | | NOT USED | | | | | | | | | | | | | | |
| BLOCK 4 | INTERLOCK | | | | | | | | | | | | | | | | | | | | | | | | | | | | | | | |
| BLOCK 5 | CUSTOMIZABLE LOCKING FEATURE | | | | | | | | | | | | | | | | | | | | | | | | | | | | | | | |
| BLOCK 6 | ERROR CODE (256) | | | | | | | | CUSTOMER NAME (ID NUMBER 4096) | | | | | | | | | | | | OPERATOR ID (16) | | | | NOT USED | | | | | | | |
| BLOCK 7 | USER DATA OR PASSWORD | | | | | | | | | | | | | | | | | | | | | | | | | | | | | | | |

FIG. 9

METHOD AND APPARATUS FOR COMMUNICATING BETWEEN PRINTER OR LAMINATOR AND SUPPLIES

BACKGROUND OF THE INVENTION

The present invention claims priority to Provisional Application Serial No. 60/117,123 and filed Jan. 25, 1999.

The present invention relates to electronic printers and laminators of the type used to print or laminate a substrate. More specifically, the present invention relates to the transfer of data between the electronic printer or laminator and supplies which are used during operation of the printer.

Electronic printers are used for printing onto the substrate. Examples of such printers include bubble jet, dye sublimation, impact, and laser printers. In general, all such printers require some type of supply for their continued operation. Examples of such supplies include ribbon, ink, toner cartridge, print medium, overlaminate film, cleaning tape, cleaning roller, etc.

U.S. Pat. No. 5,755,519, issued May 26, 1998 and entitled "PRINTER RIBBON IDENTIFICATION SENSOR" describes an identification system for a hub which carries a ribbon. This allows the printer to receive information from the ribbon core such as the type of ribbon or the particular section or panel of ribbon being printed. The information is encoded magnetically or through bar coding. However, the information carried on the ribbon is fixed and can not be changed during use.

SUMMARY OF THE INVENTION

A printer or laminator for printing or laminating onto a substrate includes a substrate feed mechanism configured to secure the substrate during printing and a print mechanism configured to print on the substrate. A transceiver is configured to transfer power through a non-physical link to a radio frequency (RF) circuit carried on a printer or laminator supply to thereby power the RF circuit. The transceiver also responsively receives printer or laminator supply data through a non-physical link from the RF circuit.

BRIEF DESCRIPTION OF THE DRAWINGS

FIG. 9 is an example memory map for use with the present invention.

DETAILED DESCRIPTION OF THE ILLUSTRATIVE EMBODIMENTS

Figure 1:
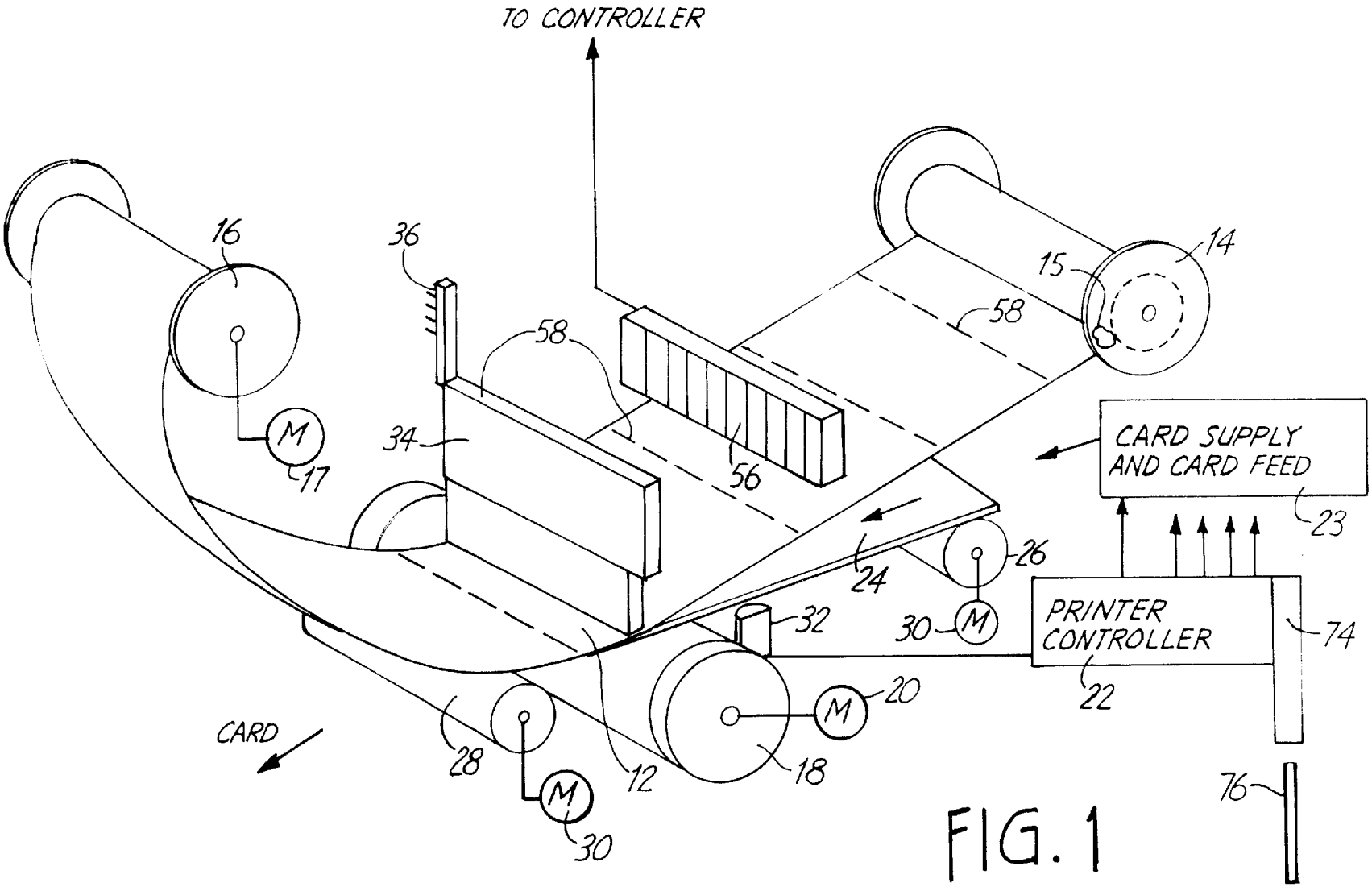
FIG. 1 is a schematic representation of a thermal printer head and ribbon shown in use with a ribbon index code and e sensor and schematically showing an alterable core.

In FIG. 1, a schematic representation shows a printer ribbon 12 provided from a supply roll or core 14 that would include the alterable, embedded identification tag or circuit (ID tag) shown generally at 15. The ribbon 12, for purposes of illustration, extends to an optional take up roll 16, the core of which also could have an ID tag if desired. The ribbon 12 passes over a printing platen 18 that is rotatably driven by a motor 20, under central control from a printer controller 22, The take up roll 16 can be driven by a motor 17 if desired and that can be synchronized with a drive of the roller 14 by the printer controller 22. A card or substrate 24 to be printed on is driven forward and backward on suitable rollers 26 with driver motors 30 that synchronize it with the movement of the individual color panels or frames that repeat in a sequence or group on the ribbon 12.

A conventional thermal print head 34 can be supported on a printer frame 36, relative to platen 18. The printing operation is synchronized through controller 22 using a card sensor 32 so that the card 24 would be printed appropriately. The card 24 will come from a card supply and card feeder 23 in a conventional manner using the powered rollers 26 driven by stepper motors 30 as controlled by the printer controller 22. The controller 22 also controls motor 20 for platen 18.

Figure 2:
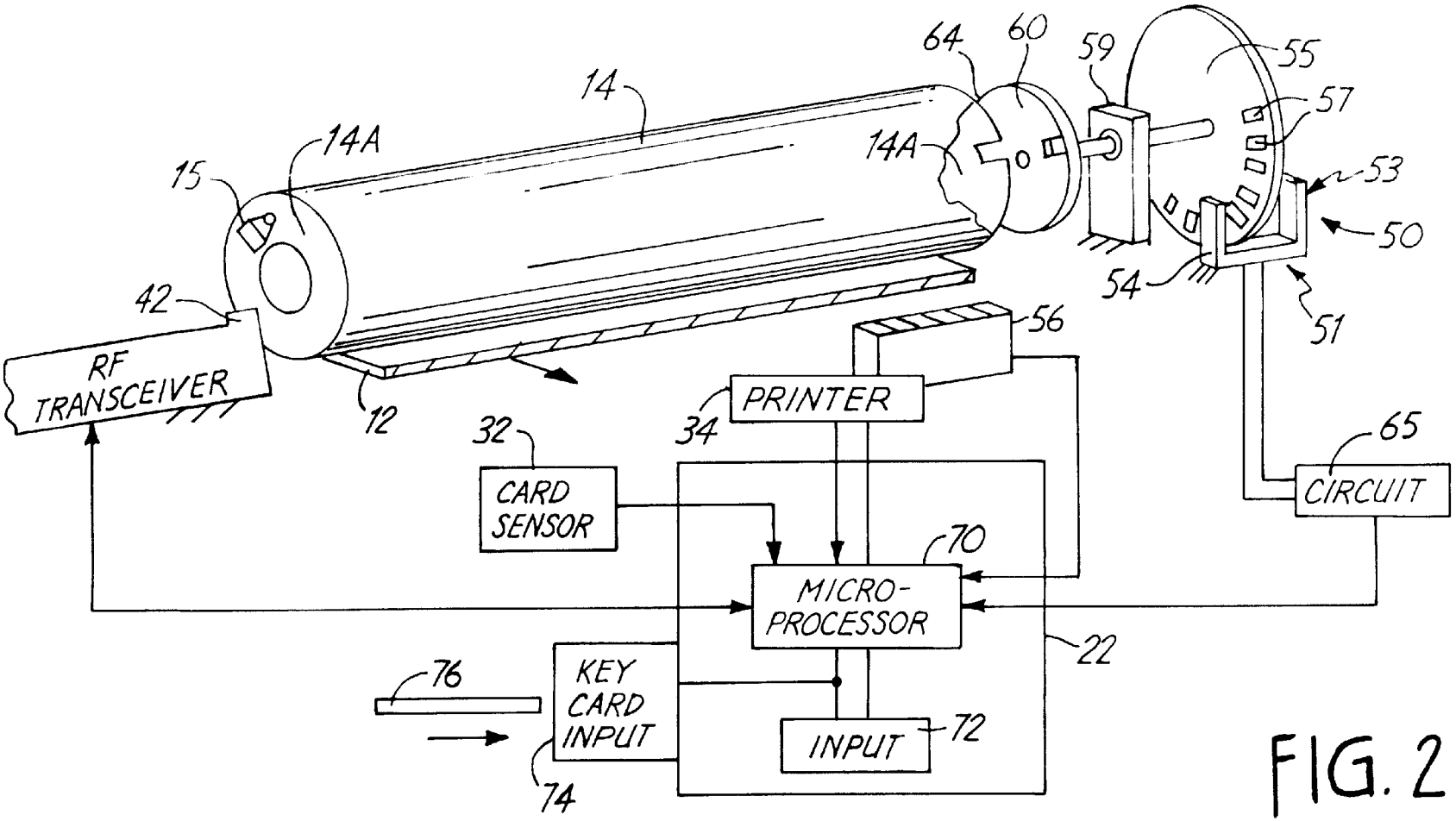
FIG. 2 is a schematic representation of a printer ribbon core and control system using Radio Frequency circuit in core schematically shown.

In FIG. 2, a schematic arrangement of a ribbon core, ID tag, transmitter/receiver (sensor) and the controls is shown. The supply roll 14 is illustrated schematically, and it shows the ribbon or web 12 coming off the supply roll.

A Radio Frequency transmitter/receiver circuit head or antenna (or read/write circuit, head or antenna) 42 is positioned adjacent to one end of the ribbon supply roll 14, and the Radio Frequency ID tag 15 is illustrated schematically as being embedded in the core 14A of the ribbon supply roll. The antenna 42 is positioned closely adjacent to the core 14A of the ribbon supply roll 14, so that it can transmit to and receive from ID tag 15 low power Radio Frequency (RF) signals. However, with more powerful signals or more sensitive electronics, the spacing can be any suitable distance.

At the opposite end of the ribbon supply roll 14, an encoder system for encoding supply roll rotational information is illustrated at 50. This type. of encoder for roll position can be used for cooperating with the ID tag information to provide records or information as to ribbon usage and the like back to the ID tag so that when the ribbon supply roll is removed from a printer, and subsequently placed in another printer, information such as the number of prints remaining, and the number of prints used can be provided, as well as ensuring that the position of the roll is proper when installed. The encoder 50 is well known and includes an encoder wheel 55 that has a plurality of apertures 57 that will transmit light. The apertures 57 are separated by opaque or light blocking segments. The wheel 55 is supported for rotation with the ribbon supply roll 14. A suitable bearing arrangement as shown at 59 can be used if desired. Wheel 55 is mounted on a shaft that has a drive coupler 60 thereon, which is provided with a suitable key that will interfit with an end slot 64 in the core 14A. The wheel 55 is driven by the ribbon supply roll 14 when the drive parts are engaged.

An optical sensor illustrated schematically at 51 has a light source 53 and a receiver 54. The receiver 54 as shown is a light sensitive diode, so that each time an opening 57 moves between the light source and the receiver there is a pulse that indicates the rotational position of the ribbon supply roll 14. The number of pulses received by circuitry 65 indicates the amount of rotation, and the circuit keeps a count of the number of pulses. These count signals are provided to a microprocessor 70 that forms part of the printer controller 22. Of course, more complex techniques can be used, for example, if the ribbon undergoes bidirectional movement.

The printer controller 22 can include an input circuit shown at 72 that can provide both manual inputs for printer control of the printer head 34, and signal inputs from the ID tag, or a key card input directly to the microprocessor.

One of the features of the present invention is that the printer controller 22 can have a key card input circuitry 74 in which a programmed key card or "mart" card key 76 can be inserted to ensure that the printer, and thus the printer ribbon, will not be operated unless the correct key card has been inserted and the correct algorithm interpreted for unlocking or enabling the printer controller 22. The use of a smartcard is set forth in U.S. application Ser. No. 09/263;343, filed Mar. 5, 1999 and entitled "SECURITY PRINTING AND UNLOCKING MECHANISM FOR HIGH SECURITY PRINTERS" which incorporated herein by reference. Key card inputs are known in the field, and can comprise a number of different signals that can be used in an algorithm to ensure that the printer controller would be unlocked or enabled only when the appropriate card is inserted. The card also can include information that can be correlated to a checking of the signals from the ID tag or controller and from the key card by the Radio Frequency transmitter/receiver 42 to insure that the appropriate ribbon has been inserted into the printer before the printer controller is unlocked for use. This can be used to lock the printer and ribbon or laminate so that only the proper laminate, in the proper order can be used in a high security implementation. This can also be used to match a person with a password to a ribbon.

Additionally, the ribbon information that is coded onto the ribbon by the bar codes or similar indicia 58 and read from the infrared sensors 56 can be fed directly to the microprocessor 70 of the printer controller so that a wide range of information is available to the microprocessor 70 before enabling the printer. One such technique is described in U.S. patent application Ser. No. 09/309,391, filed May 10, 1999 and entitled "ID CODE FOR COLOR THERMAL PRINT RIBBON which is incorporated herein by reference. The microprocessor can thus provide various information back to the Radio Frequency transmitter/receiver or read/write antenna 42. Additionally, the microprocessor can verify the ribbon against the various settings of the printer and prevent operator error.

Figure 3:
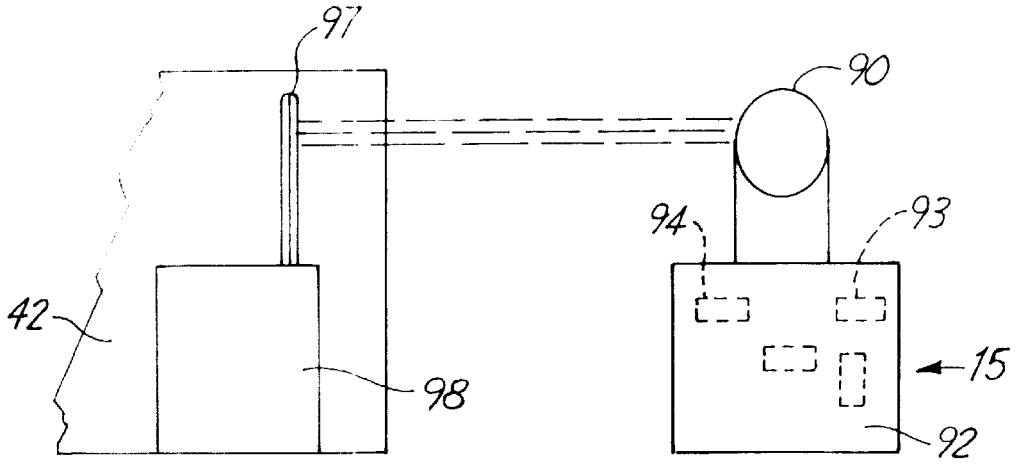
FIG. 3 a schematic representation of a Radio Frequency transmitter/receiver and ID tag for ribbon identification.
Figure 4:
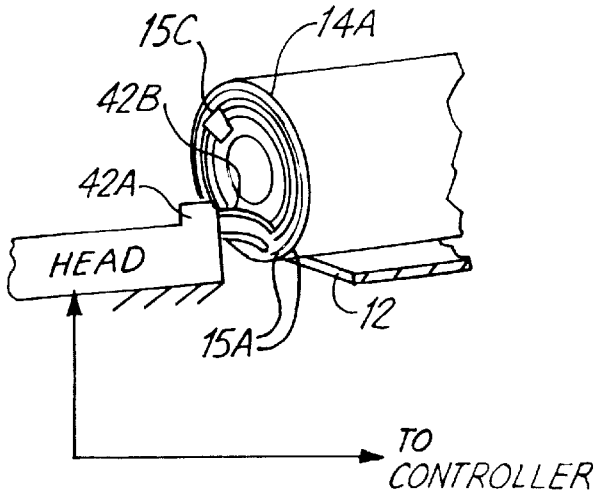
FIG. 4 a is a fragmentary schematic perspective view of an alternate embodiment of the invention.

FIG. 3 is a schematic representation of a typical RF embedded circuit ID tag 15, which includes a small wire loop antenna 90, and a chip 92 on which circuit components are provided The chip 92 can include memory such as that shown at 93, and a transmitter/receiver circuit 94 of very low power capacity. The memory can act as a counter and be decremented for each print made, for example so the prints remaining are known, and a binary code unique to the ribbon can be stored. FIG. 3 shows the read/write circuit antenna 42 positioned adjacent to the ID tag 15. The antenna 42 has an antenna portion 97 that can transmit and receive RF signals to and from the antenna 90 on the circuit for the ID tag 15. The antenna or read/write head 42 includes circuitry 98 that provides signals to and from the microprocessor 70. The transmitter/ receiver or read/write antenna 42 can provide signals that will energize digital components on the ID tag for transmission of data from the counters or memory 93 back to the circuit 98 on the antenna 42, which indicates the status of the ribbon on core 14A, and some identification parameters, such as the serial number, lot code, date code, password or errors. The information can indicate the type of ribbon on the roll, or include a code which permits operating with only a specific printer or group of printers and similar information.

It should be noted that the transmitter/receiver 42 can be a fixed installation, as stated, that would transmit through the packaging used for the ribbon, when received from a supplier, so that the ID tag 15, when using RF transmissions, could be preprogrammed with identification as to type of ribbon and the like, subsequent to packaging without breaking the package open, either by the printer manufacturer or by a distributor. The type of ribbon can be coded in, including information about the density of the dye in individual panels and when the ribbon is placed into a printer. This information can be read out by the transmitter/receiver 42 and provided to the printer controller microprocessor 70 to adjust the print head for the heat level needed for different densities of panels of ribbon to improve image quality. When ribbon information is correlated with the encoder circuitry 50 information through the microprocessor 70, the information about the number of prints that remain can be written to the ID tag 15 at the end of the printing cycle if the ribbon is to be removed from the printer, so that the next time that the ribbon is placed into a printer the exact number of prints that are left is known. The spool or roll size changes as the ribbon is used and the torque and tensioning of the ribbon roll drive motors can be changed to adjust for decreasing ribbon spool size and weight to improve image quality.

Further, the printer 34 and the controller 22 can provide date code information that can be encoded into the ID tag 15, using antenna 42 so that it will be known if the ribbon shelf life has expired. The ID tag 15 can be programmed by antenna 42 with password information so that particular key card 76 could have to have a password that must match with a password on the ID tag 15 for the ribbon before the printer would be enabled. Thus a particular key card would have to be inserted before the printer would work with a particular ribbon. This is especially useful if there are custom holograms used for laminating the card. This is advantageous because it provides an additional level of security when used in sensitive installations such as military installations or printing driver licenses. The ID tag will further permit determining whether or not a ribbon can be used with any particular printer. The card 76 further can be used in connection with the ID tag 15 so that only a set number of prints can be issued by a single card 76, which information is presently used on many cards, limiting the uses to such set number. Other features can include information from a printer programmed into the ID tag 15 which indicates the type of printer used last. This information could be erased and reentered when the print ribbon is again used. The ID tag 15 is preferably RF programmable and readable.

When coordinated with the information about the individual frames received from the infrared sensor 56, identification, positioning, and operations of the ribbon can be completely controlled by the printer.

Figure 5:
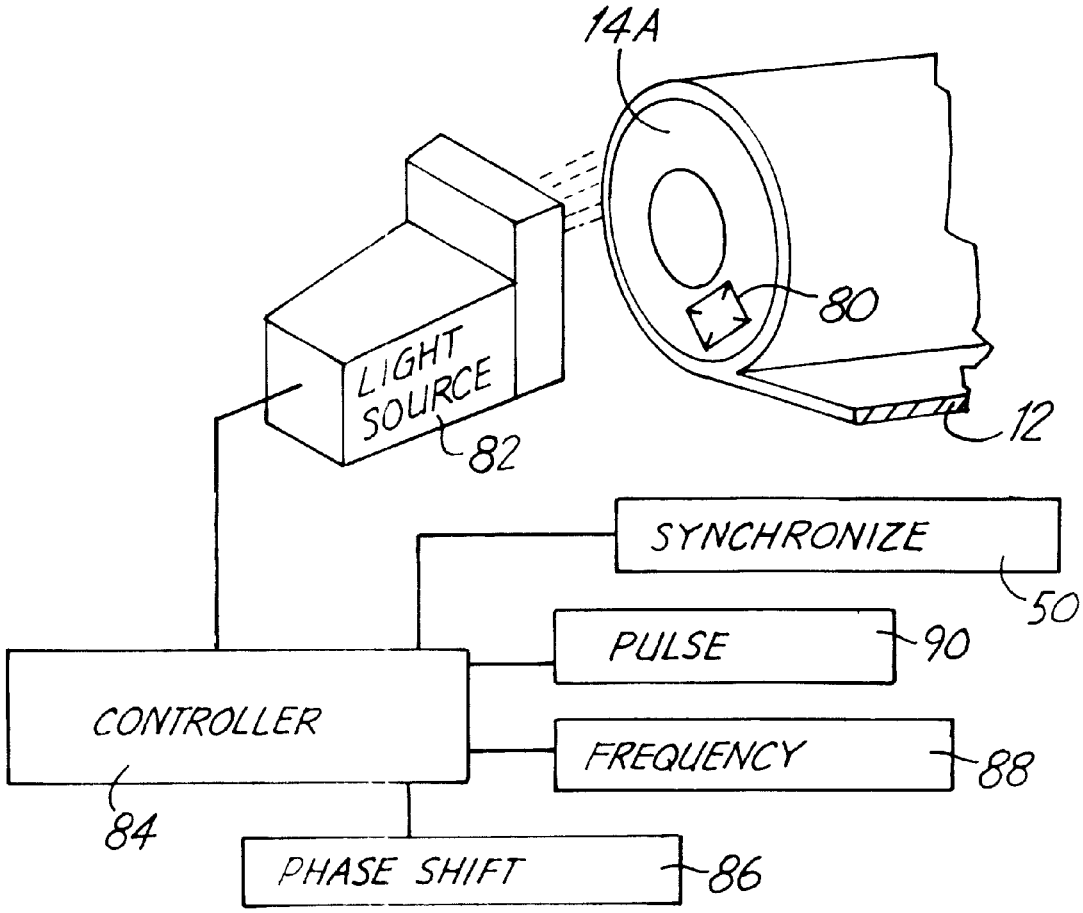
FIG. 5 is a fragmentary schematic perspective view of an embodiment that uses light signals for providing and receiving information.

A further modified form of the invention is illustrated in FIG. 5, where a core 14A is provided with a light sensitive circuit ID tag 80 that has light sensitive circuit elements that are in line to receive light or radiant energy from a light signal source circuit or signal circuit head 82, that transmits light with sufficient intensity to provide a signal to change a state in the tag 80 to record information. The light transmitted can be in the infrared range or in the visible light range. The light signal source also can receive signals from the ID tag 80 if the tag 80 is powered to provide light. A controller 84 controls the source or head 82 and can provide phase shift inputs from source 86, control of frequency from source 88, pulsing codes from source 90 and it can control intensity.

Figure 6:
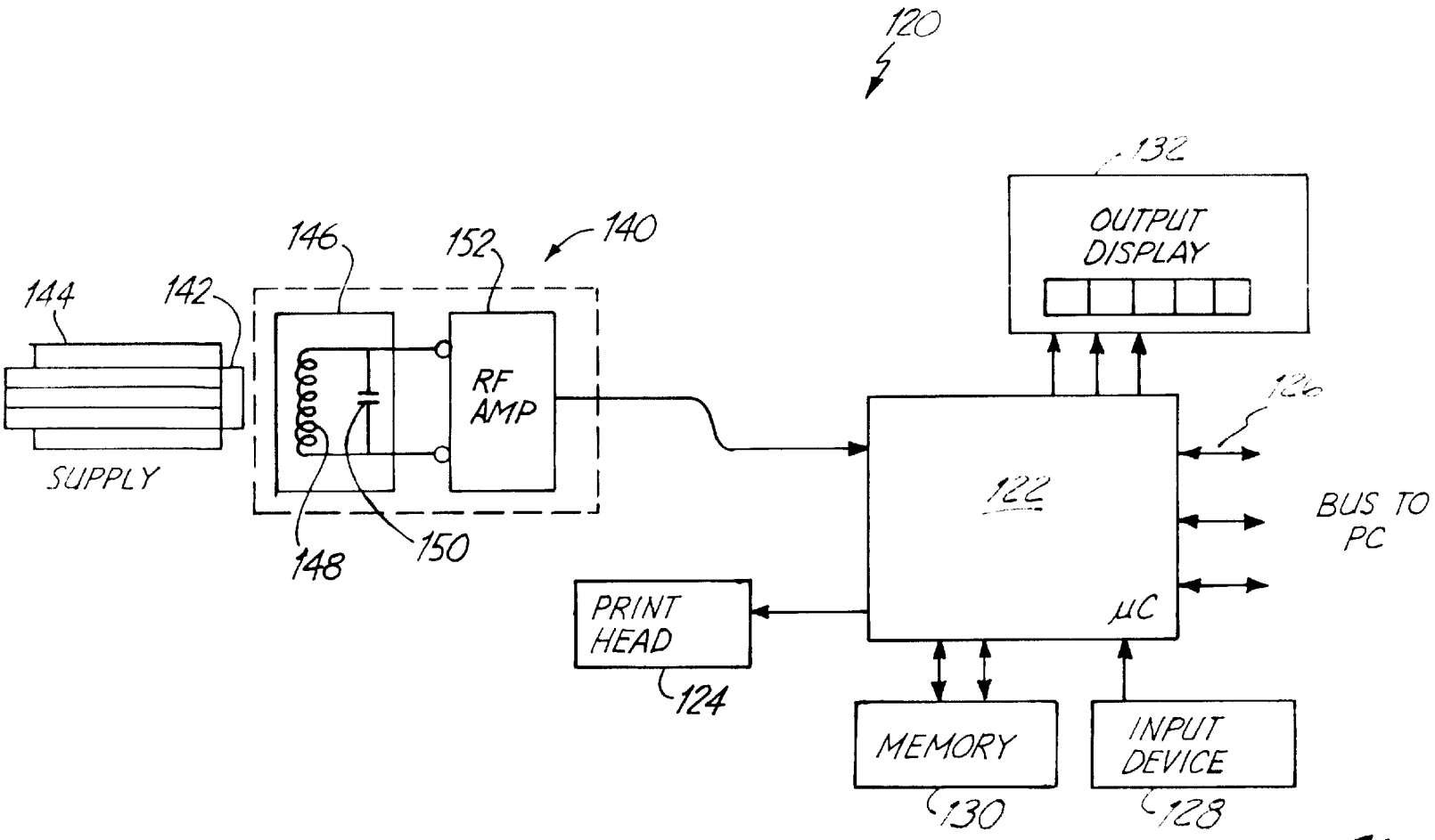
FIG. 6 is a simplified block diagram showing a printer in accordance with the present invention.

FIG. 6 is a simplified block diagram of an electronic printer 120 which illustrates more general aspects of the present invention. Printer 120 includes a controller or microprocessor 122 which is used to control print head 124 based upon data received through bus 126 which couples to a PC or other remote unit (not shown). Microprocessor 122 can received data through input device 128 and can store data in memory 130. Output information is provided through output display 132. Printer 120 also includes a transceiver 140 in accordance with the present invention for use in coupling to a radio frequency identification (RFID) tag 142 carried on supply 144. Transceiver 140 is configured to transfer power through a non-physical link to a radio frequency circuit carried in RFID tag 142. This causes RFID tag to responsively transmit data over a non-physical link to transceiver 140. Transceiver 140 includes an antenna 146 having a coil 148 and a capacitor 150. Antenna 146 couples to a radio frequency amplifier 152 which receives supply data from tag 142 and provides the supply data to controller 122.

Supply 144 can be any type of supply which is used with electronic printer 120. For example, supply 144 can comprise ribbon, intermediate transfer film, hologram material, toner, cleaning tape or ink such as for use with an ink jet or other type of printer. The RFID tag 142 can be any such RFID tag such as those which can be purchased commercially. One type of RFID tag is available from TEMIC Semiconductors a division of ATMEL located in San Jose, Calif. For example, the TEMIC Model No. TK5550 is one such RFID tag.

Figure 7:
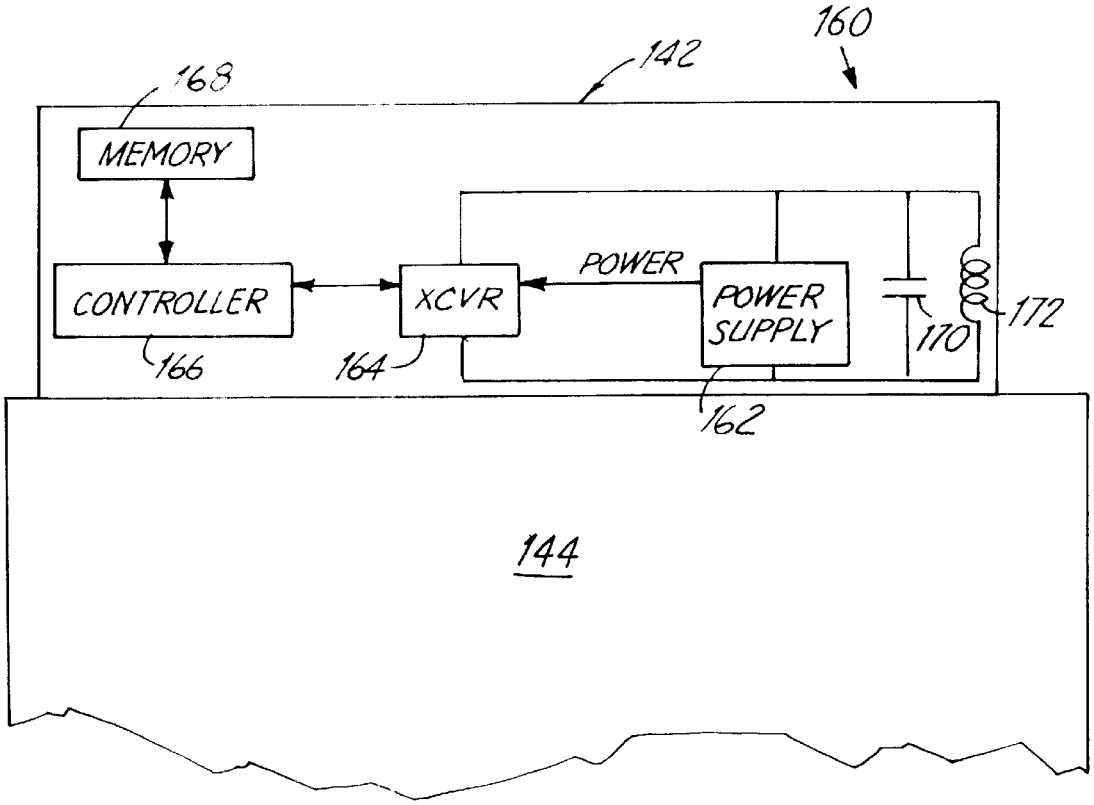
FIG. 7 is a simplified block diagram showing a printer supply including a radio frequency identification tag in accordance with the present invention.

FIG. 7 is a simplified block diagram showing RFID tag 142 coupled to printer supply 144. RFID tag 142 includes an antenna 160 formed by an electrical coil which couples to a power supply 162 and transceiver circuitry 164. A controller 166 couples to memory 168 and to transceiver circuitry 164. A tuning capacitor 170 is also provided in series with the coil 172. In operation, coil 148 of transceiver 140 is powered by RF amplifier 142 such that an inductive coupling occurs with coil 172 of RFID tag 142 when the two are in close proximity. However, in another embodiment a sufficiently strong signal or sufficiently sensitive circuitry are used whereby the tag 142 can be spaced a distance from coil 172. In one embodiment a 125 KHz signal is used to drive coil 148 which then inductively couples to coil 172.

Power supply 162 generates a stable power output used to power all of the circuitry within RFID tag 142 received through this inductive coupling. By modulating the signal, data can be transferred between transceiver 140 and RFID tag 142. Data from RFID tag transceiver 164 is provided to a controller 166. Controller 166 can record information or read information from memory 168. This configuration allows bi-directional communication between the RFID tag 142 and transceiver 140. In another embodiment, an internal power source such as a battery is used to power tag 142. In another embodiment, a physical connection to the printer or laminator is used to power tag 142.

Printer supply 144 can be any type of supply which is used by printer 120 in the printing process. For example, if printer supply 144 is a ribbon which could be carried on a spool or in a cartridge, various data can be stored in memory 168. This data includes the make and supplier of the ribbon such that operation of print head 124 can be optimized (i.e., the proper thermal printer head voltage can be optimized for a given dye carried on the ribbon) . Further, a date code can be stored in memory to monitor the aging of the ribbon or other material. A lot code and material code can be stored in memory 168 for use in optimizing printing. Information regarding the ribbon panel or ink jet ink quantity can be stored in memory 168 and updated during use of the ribbon or ink such that the total quantity of remaining ribbons or ink can be read by printer 120 and stored in the supply tag. Additionally, information regarding ribbon quantity can be used when adjusting web tension of the ribbon as it moves between a supply spool and a take-up spool or in the case of ink jet, adjust the motor control for the amount of ink weight. Ribbon panel size information can be stored in memory 168 and used to provide diagnostics if the ribbon panel size does not match the size of the substrate. A part number stored in memory 168 can be used for diagnostics and for reordering additional supplies.

If supply 144 is an intermediate transfer film, supplier, date code information, lot code and material code information can be stored in memory 168 as can film panel quantity information, film panel size and part number. Film thickness information stored in memory 168 can be used to adjust the print head or laminator for the correct heat transfer level and use in controlling web tension.

If supply 144 is hologram or an OVD (Optical Variable Device) supplier, date code, lot code and material information, film quantity, film panel size, material thickness and/or part number information can be stored in memory 168 as described above. Additionally, a private key for digital encryption can be stored in memory 168 and used as a security key to prevent unauthorized use of the material. For example, printer 120 will not be able to print unless the correct security key is received from the PC through bus 126 which is used to unlock the material using the private key stored in memory 168.

If supply 144 is an ink jet ink supply or toner supply, supplier, date code, lot code and material information, ink/toner supply quantity and part number information can be stored in memory 168. Supply 144 can also comprise a laminate material for a laminator and memory 168 can store information such as lot code and material information, date code, supplier, material thickness, size, quantity, lamination and characteristics in heating requirements or other information. Similarly, if supply 144 is a cleaning web for cleaning rollers in a printer or laminator, similar information can be stored in memory 168. Additionally, memory 168 can contain the number of times the cleaning supply has been used such that an indication can be provided that the supply should be replaced.

If supply 144 comprises a substrate or print media, such as an identification card, memory 168 can be used to store information relating to the card size, thickness and substrate materials so that printing or lamination can be optimized for these materials. Additionally, memory 168 can be used to store coded security information fox an identification card. For example, a security code stored in memory 168 can read by other devices such as a security door and used to gain access to a secure location by using the identification card. This data can also be used to interlock with smart chip information carried on the identification card or other information printed onto the card.

Figure 8:
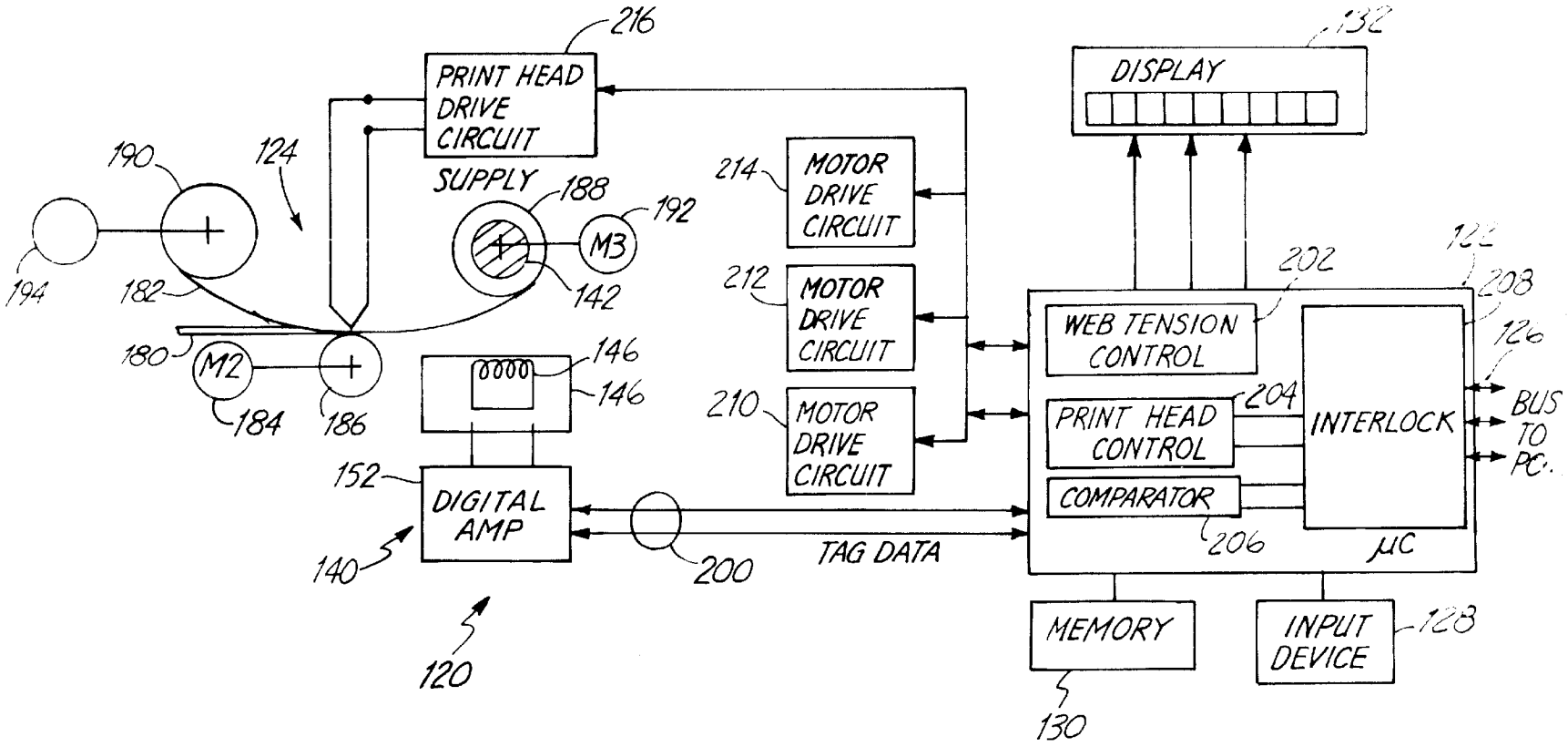
FIG. 8 is a more detailed block diagram of the printer of FIG. 6 and also illustrates an embodiment with a laminator.

FIG. 8 is a block diagram of printer 120 in greater detail. Printer 120 is shown receiving card 180 which passes proximate ribbon 182 and print head 124. A motor 184 drives a platen 186 while ribbon 182 moves between supply reel 188 and take-up reel 190 under the control of motor 192 and 194, respectively. Microprocessor 122 receives RFID tag data over bus 200 and includes web tension control 202, print head control 204, comparator 206 and interlock 208. Microprocessor 122 controls motors 194, 184 and 192 using motor drive circuits 210, 212 and 214, respectively while controlling print head 122 using print head drive circuitry 216. In various aspects of the invention, microprocessor controls web tension, print head heating and card movement based upon data received from an RFID tag 142 carried in supply spool 188. Comparator 206 is used to prevent printing through interlock 208 if date information carried in RFID tag 142 indicates that the ribbon has degraded due to age. Alternatively, this information can be displayed in display 132 and the operator can make a decision whether to use the material.

FIG. 8 also illustrates an embodiment in which an RFID tag 142 is used in a laminator. In such an embodiment, element 124 comprises a heated roller or other heating device and is controlled by a laminator drive circuit. Temperature feedback can also be provided from the laminator. In such an embodiment, the memory 168 in the RFID tag 142 can contain information regarding parameters which effect lamination temperature. Such information includes, for example, lamination film type, lamination film supplier, thickness, width, age such as through a date code or other such information.

In yet another aspect of the present invention, the information is transferred from the supply to the printer (or from the printer to the supply) over a physical connection such as through electrical wiring. In such an embodiment, the supply include electrical contacts to which the printer makes electrical contact when the supply is coupled to the printer. In such an embodiment, the power for the tag can be provided over the electrical connection. In another embodiment, a single pair of electrical connections are provided which carry both power and data between the supply and the printer. Referring to FIGS. 6 and 7, in such an embodiment the output from controller 166 can be optionally sent through a transceiver 164 and through a direct connection to microprocessor 122 in the printer/laminator. The transmission can be in any suitable format, for example, a binary format or a modulated signal such as an RF signal. Another non-contact method is to use a magnetic field to transmit information. This can be accomplished by using a magnetic head instead of an RF antenna. In another example of a non-physical link, an optical connection is provided between the supply and the printer or laminator.

FIG. 9 is an example memory map for memory 168 in the RFID TAG 142. In the example of FIG. 9, the memory includes eight blocks (block 0 through Block 7) each having 32 bits (address of 0–31). The example of FIG. 9 is for a ribbon and contains information such as the number of images printed, the material, the supplier, the panel size, the ribbon thickness, the lot code number, the expiration date month and the expiration date year, and identification number of the roll, an interlock used to lock the supply and prevent use of incorrect supplies with the printer or laminator, a second customizable locking feature which can be used, for example, for security, an error code, a customer name, an operator ID, user date or password information. Note that these are merely provided as one example and the present invention can implement any appropriate memory configuration.

Although the present invention has been described with reference to preferred embodiments, workers skilled in the art will recognize that changes may be made in form and detail without departing from the spirit and scope of the invention.

What is claimed is:

1. A printer or laminator supply comprising:

a core;

a ribbon wound on the core;

a print head receiving the ribbon;

an alterable ID tag circuit mounted to the core and including a memory containing information relating to parameters of the supply and a Radio Frequency (RF) circuit having an antenna for receiving RF signals for altering the memory;

a printer controller connected to an RF transmitter/receiver on the printer positioned adjacent to the ID tag RF circuit; and an encoder for determining the rotational position of said core connected to said printer controller, the printer controller providing parameters relating to operation of the printer, said transmitter/receiver writing selected parameters into the memory.

2. The combination of claim 1 and a key card input for receiving a key card coded to permit printer controller operation only with an appropriate key card and a password in the memory.

3. The supply of claim 1 wherein:

the ribbon includes a plurality of individual panels; and the circuit includes information relating to at least one of a number of panels remaining on the ribbon and a length of remaining ribbon.

4. The supply of claim 1 wherein the circuit comprises a light sensitive circuit.

5. The supply of claim 4 wherein the light sensitive circuit is sensitive to light selected from the group consisting of infrared light and visible light.

6. The supply of claim 4 wherein the ribbon is a thermal dye ribbon and the memory includes a dye density of the ribbon as one of the parameters.

7. The supply of claim 1 wherein the circuit is a light sensitive circuit responding to steady state light which is varied by one of the parameters consisting of phase shift and frequency shift of the light to receive and relay information.

8. The supply of claim 7 wherein the light sensitive circuit is sensitive to light selected from the group consisting of infrared light and visible light.

9. The supply of claim 7, wherein the ribbon is a thermal dye ribbon and the light sensitive circuit includes a dye density of the ribbon.

10. The supply of claim 7, wherein the printer controller is connected to a light signal transmitting head positioned adjacent to the light sensitive circuit, wherein parameters relating to operation of the printer are transmitted to the light sensitive circuit of the supply using the light signal transmitting head.

11. The combination of claim 10 and a key card input for receiving a key card coded to permit printer controller operation only with an appropriate key card and a password stored in the memory.

12. The supply of claim 1, wherein the memory includes ribbon tension information and the printer controller adjusts a tension of the ribbon in accordance with the ribbon tension information.

13. A printer or laminator supply comprising:

a core;

a ribbon wound on the core;

a print head receiving the ribbon;

an alterable ID tag circuit mounted to the core and including a light sensitive circuit and a memory containing information relating to parameters of the supply; and a printer controller connected to a light signal transmitting head on the printer positioned adjacent to the light sensitive circuit.

14. The combination of claim 13 and an encoder for determining a rotational position of said core connected to said printer controller, the printer controller providing parameters relating to operation of the printer, said light signal transmitting head transmitting selected parameters to the ID tag circuit of the supply.

15. The combination of claim 13 and a key card input for receiving a key card coded to permit printer controller operation only with an appropriate key card and a password stored in the memory.

16. A printer or laminator comprising:

supply support;

a supply including:

a core rotatably mounted to the supply support;

a ribbon wound on the core; and an alterable ID tag circuit mounted to the core and having a memory containing information relating to parameters of the supply;

an encoder adjacent the supply support and including an output signal that is indicative of a rotational position of the core; and a printer controller electrically coupled to the output signal and the alterable ID tag circuit and adapted to communicate with the alterable ID tag circuit and provide supply information thereto for storage in the memory.

17. The printer or laminator of claim 16, wherein the alterable ID tag circuit includes a radio frequency (RF) communication circuit.

18. The printer or laminator of claim 17, wherein the alterable ID tag circuit includes an antenna for receiving RF signals.

19. The printer or laminator of claim 18, wherein the printer controller includes an RF communication circuit for wireless communication of supply information to the alterable ID tag circuit.

20. The printer or laminator of claim 16, wherein the ribbon is a thermal die ribbon.

21. The printer or laminator of claim 20, wherein the supply information includes at least one parameter relating to the thermal die ribbon selected from a group consisting of: die density; remaining ribbon length; a used panel count; and a used ribbon length.

22. The printer or laminator of claim 16, wherein the supply support corresponds to one of a take-up roll and a supply roll.

23. The printer or laminator of claim 16 including a key card input for receiving a key card code, wherein the printer controller controls printer operation in accordance with a comparison between the key card code and a corresponding code stored in the memory.

24. The printer or laminator of claim 16, wherein:

the core includes first electrical contacts;

the encoder includes second electrical contacts positioned for at least intermittent contact with the first electrical contacts for measuring rotational movement of the core; and the output signal relates to the intermittent contact.

25. The printer or laminator of claim 16, wherein the alterable ID tag circuit includes a light sensitive circuit for receiving information in a form of a light signal.

26. The printer or laminator of claim 25, wherein the light sensitive circuit is sensitive to light signals consisting of at least one of infrared light and visible light.

27. The printer or laminator of claim 25, including a light signal transmitting head adjacent the alterable ID tag circuit and electrically coupled to the printer controller, the light signal transmitting head directing a light signal to the alterable ID tag circuit that is indicative of supplying information provided by the printer controller.

28. The printer or laminator of claim 25, wherein the information is communicated by the light signal by shifting at least one of a phase and a frequency of light.

29. The printer or laminator of claim 16, including a power supply configured to completely power the alterable ID tag circuit.

30. The printer of laminator of claim 16, wherein the encoder includes a sensor for sensing the rotational position of the core and providing the output signal.

31. The printer or laminator of claim 30, wherein the sensor is selected from a group consisting of an electrical contact sensor, an optical sensor, and a magnetic sensor.

32. The printer or laminator of claim 16, including a communication link between the printer controller and the alterable ID tag circuits selected from a group consisting of a radio frequency (RF) link, a magnetic link, a physical link, and an optical link.

33. The printer or laminator of claim 16, wherein the supply is selected from a group consisting of a laminate, a print ribbon, an intermediate transfer film, a hologram film material, and a thermal die ribbon.

34. The printer or laminator of claim 16, wherein the supply information relates to at least one parameter selected from a group consisting of a remainder amount of the ribbon, a used amount of the ribbon, a supplier of the supply, a shelf life of the supply, a print head voltage, a dimension of the supply, a security code, a printer setting for the supply, a laminator setting for the supply, a substrate parameter, and a supply interlock.

35. The printer or laminator of claim 19, wherein the antenna is configured to provide power to the alterable ID tag circuit.

36. The supply of claim 16, wherein the memory includes ribbon tension information and the printer controller adjusts a tension of the ribbon in accordance with the ribbon tension information.

* * * * *